US009856864B2

(12) United States Patent
Krilow

(10) Patent No.: US 9,856,864 B2
(45) Date of Patent: Jan. 2, 2018

(54) RECIPROCATING SUBSURFACE PUMP

(71) Applicant: NATIONAL OILWELL VARCO, L.P., Houston, TX (US)

(72) Inventor: Derek N. Krilow, Saskatoon (CA)

(73) Assignee: National Oilwell Varco, L.P., Houston, TX (US)

( * ) Notice: Subject to any disclaimer, the term of this patent is extended or adjusted under 35 U.S.C. 154(b) by 576 days.

(21) Appl. No.: 14/369,965

(22) PCT Filed: Jan. 4, 2013

(86) PCT No.: PCT/JP2013/050345

§ 371 (c)(1),
(2) Date: Jun. 30, 2014

(87) PCT Pub. No.: WO2013/100209

PCT Pub. Date: Jul. 4, 2013

(65) Prior Publication Data

US 2015/0017036 A1 Jan. 15, 2015

Related U.S. Application Data

(60) Provisional application No. 61/581,751, filed on Dec. 30, 2011.

(51) Int. Cl.
*F04B 47/00* (2006.01)
*F04B 7/02* (2006.01)
(Continued)

(52) U.S. Cl.
CPC ..... *F04B 7/0208* (2013.01); *E21B 43/12* (2013.01); *E21B 43/121* (2013.01);
(Continued)

(58) Field of Classification Search
CPC ..... F04B 47/02; F04B 53/126
(Continued)

(56) References Cited

U.S. PATENT DOCUMENTS 4,425,083 A * 1/1984 Peterson ..... F04B 47/08 417/554
4,778,355 A * 10/1988 Holland ..... F04B 47/08 417/378

(Continued)

FOREIGN PATENT DOCUMENTS

GB 2387401 A 10/2003

OTHER PUBLICATIONS

International Search Report and Written Opinion for International Application No. PCT/JP2013/050345, filed Jan. 4, 2013.

*Primary Examiner* — Charles Freay
*Assistant Examiner* — Christopher Bobish
(74) *Attorney, Agent, or Firm* — Conley Rose, P.C.

(57) ABSTRACT

A reciprocating pump includes an open-bottomed barrel adapted for attaching to the lower end of a production tubing string; a seating assembly having a cylindrical bore and adapted for mounting to a seating nipple at the upper end of the barrel; and a plunger assembly adapted for attaching to the lower end of a sucker rod string. The plunger assembly includes concentric upper and lower plunger sections interconnected by a double-valve, ported valve cage. The plungers are sized for sealing reciprocating engagement within, respectively, the bore of the seating assembly and the bore of the pump barrel. The lower plunger and the ported valve cage define a production chamber within the pump barrel. The upper plunger has ports allowing fluid flow from the tubing into the production chamber. Optionally, the upper plunger and the barrel may be provided with flush ports facilitating flushing of the pump to eliminate vapor lock.

16 Claims, 5 Drawing Sheets

(51) Int. Cl.

| | |
|---|---|
| ***E21B 43/12*** | (2006.01) |
| ***F04B 47/02*** | (2006.01) |
| ***F04B 53/12*** | (2006.01) |
| ***F04B 53/14*** | (2006.01) |

(52) U.S. Cl.
CPC ..... *E21B 43/127* (2013.01); *F04B 47/02* (2013.01); *F04B 53/126* (2013.01); *F04B 53/14* (2013.01)

(58) Field of Classification Search
USPC ..... 417/555.1, 555.2
See application file for complete search history.

(56) References Cited

U.S. PATENT DOCUMENTS

| | | | | |
|---|---|---|---|---|
| 5,494,109 | A | 2/1996 | Schmitt | |
| 6,945,762 | B2 * | 9/2005 | Williams | E21B 43/38 166/105.5 |
| 7,891,960 | B2 * | 2/2011 | Lea, Jr. | F04B 47/022 417/552 |
| 8,651,191 | B2 * | 2/2014 | Wilson | E21B 43/127 166/105 |
| 8,858,187 | B2 * | 10/2014 | Lane | F04B 53/20 417/53 |
| 2005/0226752 | A1 * | 10/2005 | Brown | F04B 47/02 417/555.1 |
| 2006/0002808 | A1 * | 1/2006 | Williams | E21B 43/38 417/555.1 |
| 2008/0011487 | A1 | 1/2008 | Bertane et al. | |

* cited by examiner

RECIPROCATING SUBSURFACE PUMP

CROSS-REFERENCE TO RELATED APPLICATIONS

This application is a 35 U.S.C. §371 national stage application of PCT/JP2013/050345 filed Jan. 4, 2013 and entitled "Reciprocating Subsurface Pump," which claims priority to U.S. Provisional Application No. 61/581,751 filed Dec. 30, 2011, and entitled "Reciprocating Subsurface Pump," both of which are hereby incorporated herein by reference in their entirety for all purposes.

FIELD OF THE DISCLOSURE

The present disclosure relates in general to reciprocating pumps for pumping fluids from a well, and in particular to reciprocating pumps used in association with oil wells.

BACKGROUND

Typical "sucker rod" pumps are positive displacement pumps used to pump fluids from wells. These pumps are typically located in the wellbore below the liquid level of the fluid to be pumped. The pump has an elongate cylindrical barrel connected to the lower end of a string of production tubing (which extends upward to the wellhead), plus a hollow piston (also referred to as a plunger) which reciprocates up and down within the pump barrel and in sealing engagement with the inner wall of the barrel. The plunger is connected to the lower end of a string of sucker rods extending to the surface within the production tubing, with the upper end of the sucker rod string being connected to a surface-located pumping unit (such as the well-known "horsehead" or "walking beam" pump jack), which reciprocates the rod string and the plunger.

The barrel of the sucker rod pump has an inlet check valve (comprising a standing ball and seat, and alternatively referred to as a "standing valve") at its lower end, and an outlet check valve (comprising a travelling ball and seat, and alternatively referred to as a "travelling valve") disposed within the plunger. Formation fluids flow into the wellbore and thence into the pump barrel through the standing valve when fluid pressure is sufficient to unseat the ball in the standing valve. Downward movement of the plunger through the fluid above the standing valve forces the ball in the travelling valve open, thus allowing fluid to flow through the travelling valve and into a region of the barrel above the plunger. During the plunger's downstroke, the standing valve is closed and thus prevents fluids from flowing back into the wellbore. When the plunger begins its upstroke, the ball in the travelling valve becomes seated due to the weight of the fluid column now overlying the travelling valve, and the fluid column is therefore lifted upward by the plunger. At the same time, the upward movement of the plunger draws additional fluids from the wellbore into the barrel through the standing valve, and the pumping cycle begins again when the plunger begins its next downstroke.

These pumps have proven to be mechanically sound and reliable, but they do encounter pumping problems. When the fluid being pumped is near its flash point temperature, it will partially vaporize when it is drawn into the barrel. Any vapor or gas drawn into the barrel through the standing valve must be compressed to the pressure of the production tubing on the plunger downstroke before the travelling valve will open and allow fluids out of the pump. In other words, the pressure built up in the barrel during the plunger downstroke must overcome the hydrostatic load acting on the travelling ball due to the fluid column above the plunger, or else the travelling valve will not open. However, the compressibility of any gas in the barrel makes it more difficult to build up sufficient pressure in the barrel, and this problem worsens as the amount of gas in the barrel increases.

The pressure drop that is often increased by pressure differentials through the standing valves in conventional sucker rod pumps is partially responsible for "gas locking" and for problems achieving satisfactory fluid flow into the pump when such pumps are used to pump viscous fluids (such as heavy oil). There are many types of standing cages (i.e., cages for standing valves) designed to reduce the pressure differential across the standing valve. The volume of gas or vapor within the pump can be great enough that the full downward stroke of the plunger will not produce sufficient pressure in the pump barrel to force the travelling valve open. When this happens, the pump is said to be gas-locked (or, alternatively, "vapor locked"). Pumps used to pump crude oil containing significant amounts of lighter fractions will be particularly prone to vapor locking. When an oil field is subject to a steam flood, a mixture of oil and condensate near its flashing point is produced, which also can vapor-lock a pump.

When a pump is vapor-locked, it is typically shut in for a period of time, or, alternatively, fluid is introduced into the wellbore with a "flush-by" service rig. During the shut-in period, the gas will have a chance to escape through check valves, and the pump can cool due to the absence of the heat of compression and frictional heat created by the plunger sliding up and down within the pump barrel. The vapor lock will eventually break, allowing pumping to be continued. The use of mechanical impact or tapping bottom to solve vapor lock is unacceptable.

Conventional sucker rod pumps are also often used to lift viscous or "heavy" oils, and in such conditions the standing valves can impede efficient pump performance and production, because the restricted area around and through the ball and seat of the standing valve can limit the amount of fluid that can be drawn into the pumping chamber. Similar concerns can arise when a conventional pump is being reciprocated at high speeds. The fluid cannot completely fill the pumping chamber due to frictional drag caused by the restrictive standing valve, which acts as a choking point limiting the volume of fluid allowed into the pumping chamber. A further problem commonly arising when pumping viscous fluids using conventional pumps is that solids contained in the produced fluid often contaminate the ball and seat of the standing valve, causing the pump to cease operation.

It is common practice, when a conventional sucker rod pump becomes plugged with solids from the wellbore, to use a specialized service rig called a "flush-by unit" to clean out the pump so that it can be put back into service. The flush-by unit will lift the pump out of the seating nipple or remove the plunger and standing valve. At this stage, clean fluid is pumped down the production tubing in an effort to remove contaminating solids from the tubing string and pump components. These operations cost money in terms of both the flush-by unit and lost production time.

When conventional sucker rod pumps are employed to pump viscous wells, or wells in which wellbore deviations cause frictional drag (such as in horizontal wells), the sucker rod string may be unable to fall fast enough for satisfactory oil production to be realized. Various devices and pumps have been used in the past to increase downstroke loads in order to increase downstroke speed (i.e., strokes per minute)

and thereby mitigate the frictional drag problem in deviated wellbores. However, with the increasingly common use of directional drilling to drill horizontal and other non-vertical wellbores, slower downstroke speeds continue to be a problem that limits production.

For the foregoing reasons, there is a need for a well pump which is capable of pumping volatile fluids and is resistant to gas/vapor-locking, and which will not "fluid pound" (a term well understood in the art). There is a further need for a well pump that can facilitate flushing action to remove contaminating solids from the pump without the need for a flush-by unit. In addition, there is a need for a well pump that has no standing valve, such that there is no pressure drop through the inlet valve. Furthermore, there is a need for a well pump that that is less prone to reduced downstroke speed when operating in a deviated wellbore.

BRIEF SUMMARY

The present disclosure teaches embodiments of a pumping apparatus for pumping wellbore fluids to the surface through the production tubing string of a subsurface well. The pumping apparatus comprises a tubular pump barrel having an open lower end plus an upper end attached to the lower end of a pump-seating nipple, the upper end of which is connected to the lower end of the production tubing string. The pump-seating nipple is adapted to receive a seating assembly having a cylindrical bore. Persons skilled in the art of well completions will be familiar with pump-seating nipples and seating assemblies, and will appreciate that pump-seating nipples and seating assemblies used in pumping apparatus in accordance with the present disclosure may be of any functionally suitable type.

The pumping apparatus also includes a reciprocating plunger assembly suspended from the lower end of the sucker rod string and comprising concentric and generally cylindrical upper and lower plunger sections, and a double-valve, ported valve cage connecting the upper and lower plunger sections. The valves in the ported valve cage (also referred to as the upper and lower valves) may be ball-and-seat-type valves, but are not restricted to that type; the type of valves used will be a matter of design choice to meet the specific functional requirements for a given installation.

The outer diameter (O.D.) of the upper plunger section is less than the O.D. of lower plunger section, and is selected to facilitate sealing engagement against the cylindrical bore of the seating assembly. In preferred embodiments, sealing between the upper plunger and the bore of the seating assembly is provided by means of an elastomeric packing element associated with the seating assembly bore. The O.D. of the lower plunger is selected to facilitate sealing engagement against the inner cylindrical surface of the pump barrel. Sealing between the lower plunger and the pump barrel may be provided by means of a suitable seal associated with the lower plunger, but this is by way of non-limiting example only.

In one alternative embodiment, the cylindrical wall of the upper plunger is ported to facilitate pump flushing (or "flush-by") operations. During normal operations, however, the port or ports in the upper plunger wall will remain within the cylindrical bore of the seating assembly throughout the stroke of the plunger assembly.

The seating assembly is installed in the well along with the sucker rod string and plunger assembly, but remains stationary once seated in the pump-seating nipple. The upper and lower plungers are reciprocatingly and sealingly movable within, respectively, the seating assembly and the pump barrel. The upper plunger (which optionally may be ported) provides an upper fluid seal supporting the fluid column load above the plunger assembly. The lower plunger defines the movable lower limit of a sealed production chamber within the pump barrel (as described in greater detail later herein), with the size of the production chamber dictating the maximum volume of fluid produced per pump stroke. The bottom plunger/barrel interface provides the fluid seal required in the production chamber to offset the pressure of the fluid in the production tubing plus the added pressure caused by the length and inside diameter of the flow line, thereby allowing the pump to generate sufficient pressure to offset the pressure above the upper valve in the ported valve cage between the upper and lower plungers.

The upper end of the upper plunger section projects above the fixed sealing assembly and into the production tubing string. The upper end of the upper plunger is provided with one or more flow ports through which fluid can flow from the production chamber into the production tubing (via the internal chamber of the upper plunger), and also from the production tubing back into the production chamber. These ports in the upper end of the upper plunger also facilitate the flush-by feature when the pump plungers are lowered into the inlet sub (in embodiments incorporating the flush-by feature).

A lower region of the pump barrel optionally may be ported to let fluid enter on the upstroke (in addition to wellbore fluid entering the pump barrel through its open lower end). When the lower plunger is disposed below the ports in the pump barrel, the upper plunger will extend partially into the pump barrel, with the ports in the upper plunger being below the seating assembly. With the plunger assembly in this position (i.e., the "flush-by" position), fluid is able to drain from the pump and production tubing, through the porting in the upper plunger into an annular space between the upper piston and the pump barrel, and then through the porting in the pump barrel and into the wellbore. This design feature allows the well operator to drain the production tubing, a task that would otherwise need to be carried out using a flush-by unit.

The upper plunger provides the fluid seal normally provided by a conventional ball-and-seat standing valve, thereby eliminating the standing valve. In addition, the ports in the upper plunger enable the flush-by feature and will eliminate both vapor-locking and fluid pound, by letting fluid from the tubing (which is usually degasified) back into the pumping chamber (pump barrel). These features are made possible by the double-ported valve cage configuration.

In a first aspect, the present disclosure teaches a pump assembly comprising: a pump barrel having a cylindrical wall, an upper end mounted to the lower end of a tubing string, and an open lower end; a pump-seating nipple mounted to the lower end of the tubing string; a seating assembly having a cylindrical bore, said seating assembly being in seating engagement with the pump-seating nipple; and a plunger assembly comprising an upper plunger, a lower plunger, and a transition section contiguously disposed between and interconnecting the upper and lower plungers.

The upper plunger has a cylindrical wall, an upper end, and a lower end, and defines an upper plunger chamber, with at least one fluid port being provided proximal to the upper end of the upper plunger to allow fluid entry into the upper plunger chamber. The upper plunger is reciprocatingly and sealingly movable within the bore of the seating assembly.

The lower plunger has a cylindrical wall, an upper end, and a lower end, with the outer diameter (O.D.) of the cylindrical wall of the lower plunger being larger than the O.D. of the cylindrical wall of the upper plunger. The lower plunger is reciprocatingly and sealingly movable within the pump barrel.

The transition section houses an upper valve proximal to the lower end of the upper plunger, and a lower valve proximal to the upper end of the lower plunger. The transition section has a perimeter wall with at least one fluid port therethrough, and defines a valve chamber bounded by the transition section wall and the upper and lower valves.

The portion of the pump barrel below the lower valve defines a barrel chamber, the size of which will change with reciprocating movement of the plunger assembly. The lower valve regulates fluid flow from the barrel chamber into the valve chamber, while the upper valve regulates fluid flow from the valve chamber into the upper plunger chamber;

The plunger assembly is reciprocatingly movable through alternating upstrokes and downstrokes, such that when the pump assembly is disposed within a wellbore containing wellbore fluids on the downstroke, the upper valve will be closed, and the lower valve will open to permit wellbore fluids in the barrel chamber to flow into the valve chamber and, via the fluid ports in the transition section of the plunger assembly, into an annular space between the transition section and the wall of the pump barrel. Additionally, on the upstroke, wellbore fluids will be drawn into the barrel chamber through the open lower end of the pump barrel, the lower valve will be closed, and the upper valve will open to permit fluid flow from the valve chamber into the upper plunger chamber, while at the same time lifting the fluid column in the production tubing.

In a second aspect, the present disclosure teaches a plunger assembly comprising an upper plunger, a lower plunger, and a transition section contiguously disposed between and interconnecting the upper and lower plungers. The upper plunger has a cylindrical wall, an upper end, and a lower end, and defines an upper plunger chamber, with at least one fluid port being provided proximal to the upper end of the upper plunger to allow fluid entry into the upper plunger chamber. The lower plunger has a cylindrical wall, an upper end, and a lower end, with the O.D. of the cylindrical wall of the lower plunger being larger than the O.D. of the cylindrical wall of the upper plunger. The transition section houses an upper valve proximal to the lower end of the upper plunger, and a lower valve proximal to the upper end of the lower plunger. The transition section has a perimeter wall with at least one fluid port therethrough, and defines a valve chamber bounded by the transition section wall and the upper and lower valves.

In alternative embodiments, at least one fluid port (or "upper plunger flush port") is provided through the wall of the upper plunger, and at least one fluid port (or "barrel chamber flush port") is provided through the wall of the pump barrel. These flush ports are located such that when the plunger assembly is moved to a "flush-by" position lower than the bottom of its normal downstroke, fluid can flow from the upper plunger chamber through the upper plunger flush port(s) into the annular space between the transition section and the wall of the pump barrel, and from that annular space through the barrel chamber flush port(s) into the wellbore.

BRIEF DESCRIPTION OF THE DRAWINGS

Embodiments of pumps in accordance with the present disclosure will now be described with reference to the accompanying figures, in which numerical references denote like parts, and in which.

NOTATION AND NOMENCLATURE

As used herein, any form of the word "comprise" is to be understood in its non-limiting sense to mean that any item following such word is included, but items not specifically mentioned are not excluded. A reference to an element by the indefinite article "a" does not exclude the possibility that more than one such element is present, unless the context clearly requires that there be one and only one such element. Any use of any form of the terms "connect", "engage", "attach", "mount", or any other term describing an interaction between elements is not meant to limit the interaction to direct interaction between the subject elements, and may also include indirect interaction between the elements such as through secondary or intermediary structure. Relational terms such as (but not limited to) "concentric" are not intended to denote or require absolute mathematical or geometrical precision. Accordingly, such terms are to be understood as denoting or requiring substantial precision only (e.g., "substantially concentric") unless the context clearly requires otherwise. As used in this patent document, the term "fluid" may denote a liquid, a gas, or a liquid-gas mixture, as the context may suggest or require.

DETAILED DESCRIPTION

Figure 1C:
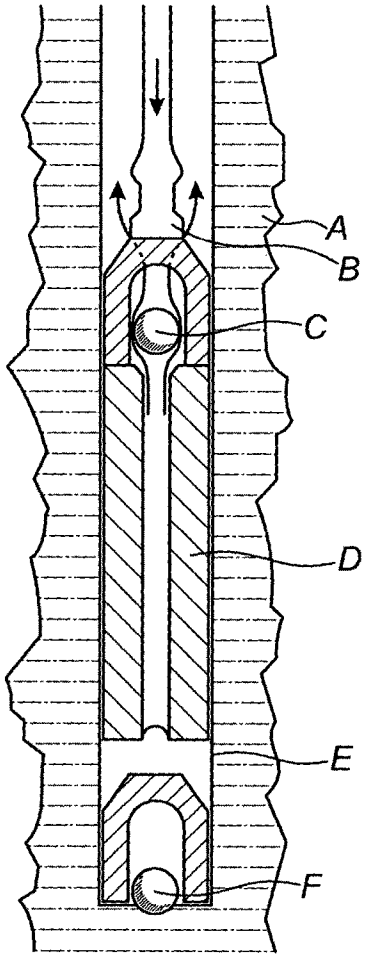
FIG. 1C (prior art)
FIG. 1C is a vertical cross-section through the prior art pump in FIG. 1A, shown with the sucker rod string and plunger on the downstroke, with the travelling valve open to allow fluid flow into the production string, and with the standing valve closed to prevent backflow into the formation.
Figure 1B:
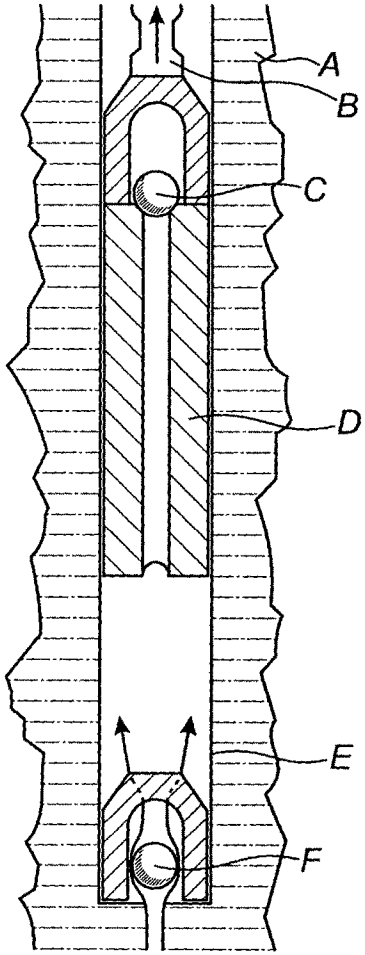
FIG. 1B (prior art)
FIG. 1B is a vertical cross-section through the prior art pump in FIG. 1A, shown with the sucker rod string and plunger on the upstroke, with the travelling valve closed, and with the standing valve open to allow wellbore fluids into the pump barrel.
Figure 1A:
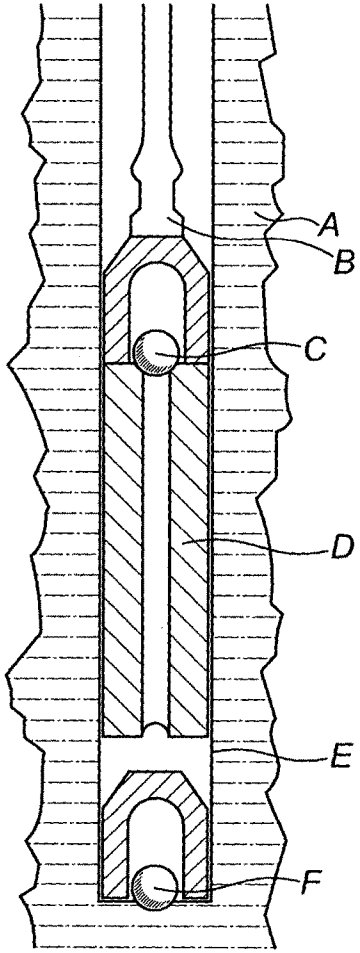
FIG. 1A (prior art)
FIG. 1A is a vertical cross-section through a prior art sucker rod pump disposed within a production tubing string in a wellbore, shown with both the standing valve and the travelling valve closed.

FIGS. 1A, 1B, and 1C illustrate a typical prior art sucker rod pump, the construction and operation of which was generally described in the Background section of this document. The arrows in FIGS. 1A, 1B, and 1C indicate the direction of both fluid flow and sucker rod movement, with reference characters in accordance with the following legend:

A—Fluid level in well
B—Sucker rod string
C—Traveling valve
D—Plunger

E—Pump barrel

F—Standing valve

FIGS. 2A, 2B, 2C, and 2D illustrate one embodiment of a subsurface pump 10 in accordance with the present disclosure, in various stages of operation. Pump 10 comprises a pump barrel 20 mounted to the lower end of a suitable pump-seating nipple 30, the upper end of which is mounted to the lower end of a string of production tubing 12. Pump-seating nipple 30 is depicted in FIGS. 2A-2D as being a very short component, but this is schematic only; typical pump-seating nipples are 12 to 18 inches in length.

Pump barrel 20 has an open lower end 20L through which wellbore fluids can flow into a barrel chamber 22 in a lower region of pump barrel 20. Preferably (but not necessarily), at least one flush port (or "barrel chamber flush port") 24 is provided through the wall of the pump barrel 20 within barrel chamber 22. In cases where flush port(s) 24 are provided, pump barrel 20 may alternatively be referred to as a ported fluid entry sub.

Pump 10 further comprises a plunger assembly 40 having a cylindrical upper plunger section 42 and a cylindrical lower plunger section 44, with upper and lower plungers 42 and 44 being concentric, and with the outer diameter (O.D.) of upper plunger 42 being less than the O.D. of lower plunger 44. The interior of upper plunger 42 defines an upper plunger chamber 43. Upper and lower plungers 42 and 44 are interconnected by a transition section 46 housing an upper valve 50 proximal to the lower end of upper plunger 42 and a lower valve 60 proximal to the upper end of lower plunger 44. In the illustrated embodiment, transition section 46 is shown as being of frustoconical configuration, but this is not essential; transition section 46 could be of a different geometrical configuration without materially affecting the function or operation of pump 10. Upper and lower valves 50 and 60 are shown as ball-type valves, each having a ball (51 or 61) and a seat (52 or 62), but this is by way of non-limiting example only. At least one fluid port 46P is provided through the wall of transition section 46. The subassembly of transition section 46, upper valve 50, and lower valve 60 may be referred to as a double-valve ported valve cage 70, and defines a valve chamber 72 bounded by the wall of transition section 46 and valve assemblies 50 and 60.

The O.D. of upper plunger 42 is sized to facilitate sealing reciprocating movement within the cylindrical bore of a seating assembly 32 adapted for engagement with pump-seating nipple 30. The seating assembly 32 is preferably provided with an elastomeric packing element 34 disposed within a seal-receiving groove formed in the bore of seating assembly 32, or other suitable sealing means for deterring entry of sand into the pump. The upper end 42U of upper plunger 42 is closed off by a cap member 41, with at least one fluid port 41P being provided through cap member 41. Optionally, and as seen in the illustrated embodiment, at least one fluid port (or "upper plunger flush port") 42P may be provided through the cylindrical wall of upper plunger 42, to facilitate flushing of the pump (as will be described in greater detail later herein). The O.D. of lower plunger 44 is sized to facilitate sealing reciprocating movement within pump barrel 20.

Plunger assembly 40, with seating assembly 32 disposed around upper plunger 42, is suspended from a sucker rod string 15 connected to the upper end 42U of upper plunger 42, and then lowered into the well until seating assembly 32 engages pump-seating nipple 30. Seating assembly then remains stationary in the well, while plunger assembly 40 is reciprocatingly movable within the well.

Optionally, pump 10 may be provided with stop means for limiting the downward travel of the plunger. The illustrated embodiment of pump 10 features stop means in the form of an annular flange 45 fixed to an upper region of upper plunger 42, and the function of this feature is best understood with reference to FIG. 2D. Although illustrated herein as an annular flange, the plunger stop means could take any functionally suitable form, including but not limited to one or more lug members welded to upper plunger 42.

Figure 2A:
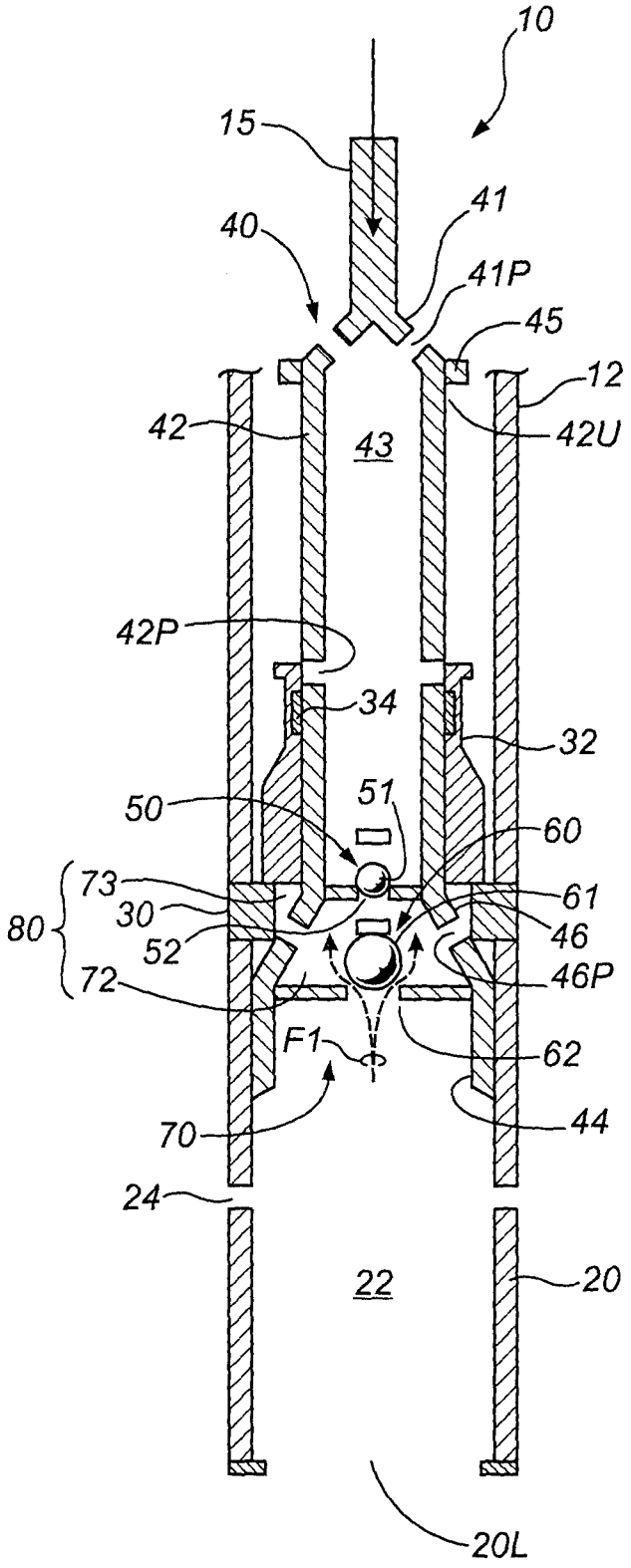
FIG. 2A is a vertical cross-section through one embodiment of a pump in accordance with the present disclosure, shown with the plunger at the beginning of its downstroke in accordance with certain embodiments of the present disclosure.
Figure 2B:
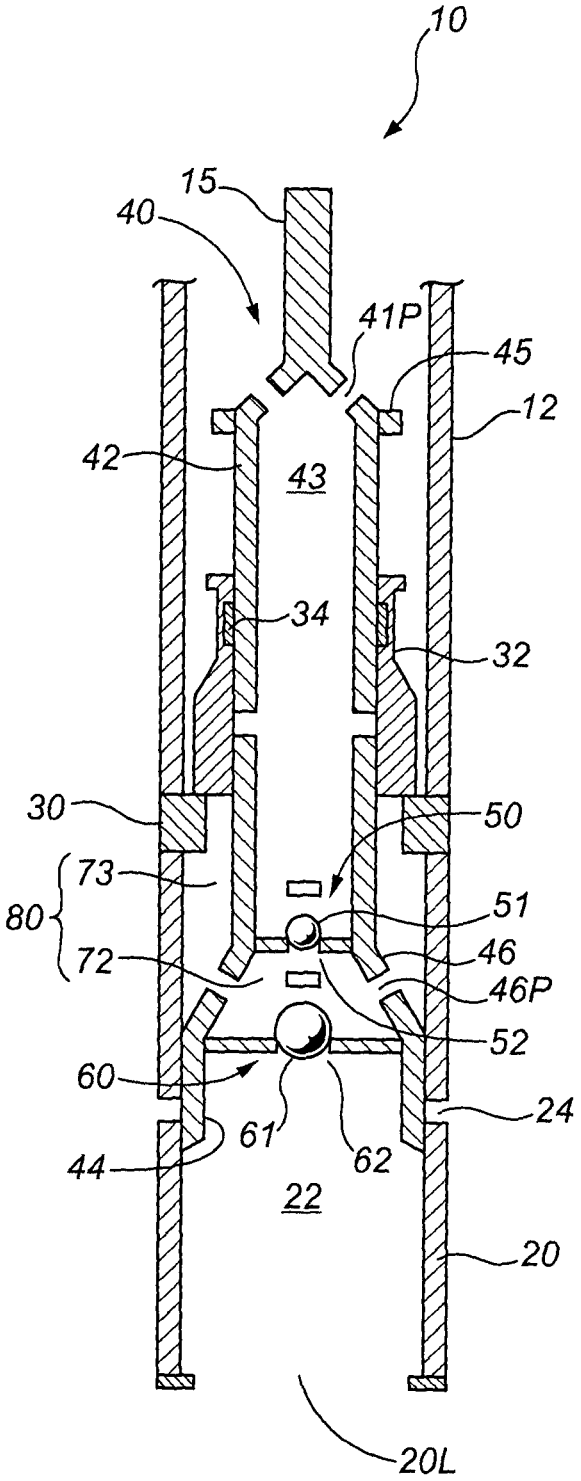
FIG. 2B is a vertical cross-section through the pump in FIG. 2A, shown with the plunger shown at the bottom of its downstroke in accordance with certain embodiments of the present disclosure.
Figure 2C:
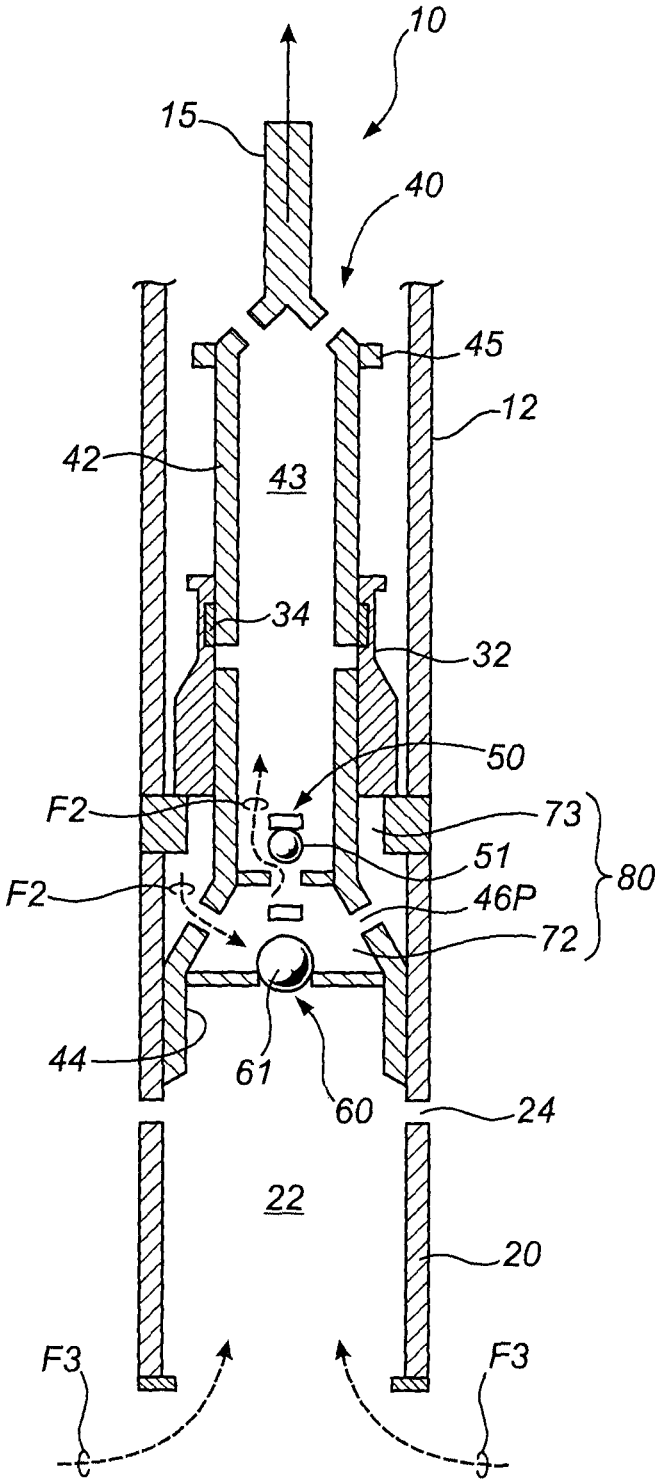
FIG. 2C is a vertical cross-section through the pump in FIG. 2A, shown with the plunger at the beginning of its upstroke in accordance with certain embodiments of the present disclosure.

Normal operation of pump 10 is illustrated in FIGS. 2A-2C. FIG. 2A shows pump 10 with plunger assembly 40 at the beginning of its downstroke. The weight of the fluid column within production tubing 12 (and upper plunger chamber 43) keeps upper valve 50 closed as shown. Barrel chamber 22 contains fluid drawn in through the open lower end 20L of pump barrel 20 (and through flush ports 24 if provided) during the preceding upstroke. The downward movement of plunger assembly 40 into the fluid in barrel chamber 22 forces lower valve 60 to open as shown, allowing fluid from barrel chamber 22 to flow (as indicated by flow arrows $F_1$) into a production chamber 80 comprising valve chamber 72 and the annular space 73 bounded by pump barrel 22, valve cage 70, and a lower region of upper plunger 42.

In FIG. 2B, plunger assembly 40 is at the bottom of its downstroke, at which stage production chamber 80 will be filled with fluid. With the downward movement of the plunger assembly having stopped, the weight of fluid in production chamber 80 causes lower valve 60 to close as shown, while upper valve 50 remains closed due to the weight of the fluid column above it.

In FIG. 2C, plunger assembly 40 has begun to rise from the position shown in FIG. 2B. At this point, pump 10 is compressing the fluid in production chamber 80, with lower valve 60 in the closed position. When the fluid in production chamber 80 reaches a pressure greater than the pressure in production tubing 12, upper valve 50 will open as shown, discharging fluid from production chamber 80 into upper plunger chamber 43 (as indicated by flow arrows $F_2$). The fluid exits upper plunger chamber 43 through fluid port(s) 41P and into production tubing 12. As plunger assembly 40 continues its upstroke, additional fluid is drawn into barrel chamber 22 through open lower end 20L of pump barrel 20 (as indicated by flow arrows $F_3$). When plunger assembly 40 reaches the top of its upstroke, a new downstroke begins, as illustrated in FIG. 2A.

Figure 2D:
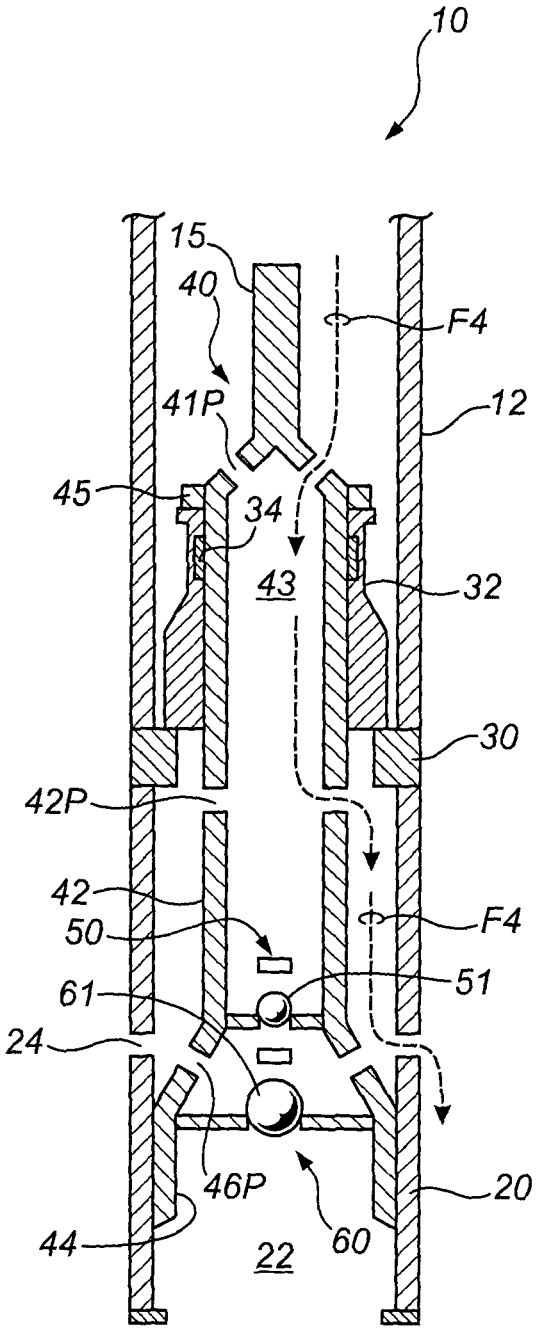
FIG. 2D is a vertical cross-section through the pump in FIG. 2A, shown with the plunger in the flush-by position in accordance with certain embodiments of the present disclosure.

FIG. 2D illustrates pump 10 in the "flush-by" position, with plunger assembly 40 at a position lower than the bottom of its normal operational downstroke (per FIG. 2B) such that fluid ports 42P in upper plunger 42 are below seating assembly 32, and lower plunger 44 is below flush ports 24 in pump barrel 20. With plunger assembly 40 in this position, a flushing fluid introduced into production tubing 12 can enter upper plunger chamber 43 through fluid ports 41P, then exit upper plunger chamber 43 through fluid ports 42P into annular space 73 between upper plunger 42 and pump barrel 20, and then exit annular space 73 through flush ports 24 in pump barrel 20 into the wellbore (as indicated by flow arrows $F_4$). Upper and lower valves 50 and 60 remain closed throughout this operation due to the weight of flushing fluid in production tubing 12 and upper plunger chamber 43. Pump 10 can be set to attain this flush-by position should gas-locking be a concern.

It will be readily appreciated by those skilled in the art that various modifications to embodiments in accordance with the present disclosure may be devised without departing from the scope and teaching of the present teachings, including modifications using equivalent structures or materials hereafter conceived or developed. It is to be understood that the scope of the claims appended hereto should not be limited by the preferred embodiments described and illustrated herein, but should be given the broadest interpretation consistent with the description as a whole. It is also to be understood that the substitution of a variant of a claimed element or feature, without any substantial resultant change in functionality, will not constitute a departure from the scope of the disclosure.

The invention claimed is:

1. A pump assembly comprising:

(a) a pump barrel having a cylindrical wall, an upper end adapted for mounting to a lower end of a tubing string, and an open lower end;

(b) a pump-seating nipple adapted for mounting to the lower end of the tubing string;

(c) a seating assembly having a cylindrical bore, said seating assembly being in seating engagement with the pump-seating nipple;

(d) a plunger assembly comprising:

d.1 an upper plunger having a cylindrical wall, an upper end, and a lower end, said upper plunger defining an upper plunger chamber and having a fluid port extending through the wall and located proximal to the upper end of the upper plunger and adapted for allowing fluid entry from the tubing string into the upper plunger chamber, and said upper plunger being reciprocatingly and sealingly movable within the bore of the seating assembly;

d.2 a lower plunger having a cylindrical wall, an upper end, and a lower end, with the outer diameter of the cylindrical wall of the lower plunger being larger than the outer diameter of the cylindrical wall of the upper plunger, said lower plunger being reciprocatingly and sealingly movable within the pump barrel; and d.3 a transition section contiguously disposed between the lower end of the upper plunger and the upper end of the lower plunger, said transition section housing an upper valve proximal to the lower end of the upper plunger, and a lower valve proximal to the upper end of the lower plunger; said transition section having a wall having at least one fluid port therethrough, and defining a valve chamber bounded by the wall and the upper and lower valves;

wherein:

(e) the portion of the pump barrel below the lower valve defines a barrel chamber;

(f) the lower valve regulates fluid flow from the barrel chamber into the valve chamber; and (g) the upper valve regulates fluid flow from the valve chamber into the upper plunger chamber.

2. The pump assembly as in claim 1, wherein:

(a) an upper plunger flush port is provided through the wall of the upper plunger;

(b) a barrel chamber flush port is provided through the wall of the pump barrel; and (c) the plunger assembly is selectively movable to a position lower than the bottom of its normal downstroke, such that fluid can flow from the upper plunger chamber through the upper plunger flush port into an annular space between the transition section and the wall of the pump barrel, and out of said annular space through the barrel chamber flush port.

3. The pump assembly as in claim 1 wherein the transition is of frustoconical configuration.

4. The pump assembly as in claim 1 wherein the upper and lower valves comprise ball-type valves.

5. The pump assembly as in claim 1, further comprising stop means for limiting the downstroke of the plunger assembly.

6. The pump assembly as in claim 1, further comprising an elastomeric packing element disposed within a seal-receiving groove formed in the bore of the seating assembly.

7. A plunger assembly comprising:

(a) an upper plunger having a cylindrical wall, an upper end, and a lower end, said upper plunger defining an upper plunger chamber and having a fluid port extending through the wall and located proximal to the upper end of the upper plunger and adapted for allowing fluid entry from a tubing string into the upper plunger chamber, and said upper plunger being reciprocatingly and sealingly movable within a bore of a seating assembly;

(b) a lower plunger having a cylindrical wall, an upper end, and a lower end, with the outer diameter of the cylindrical wall of the lower plunger being larger than the outer diameter of the cylindrical wall of the upper plunger, said lower plunger being reciprocatingly and sealingly movable within a pump barrel; and (c) a transition section contiguously disposed between the lower end of the upper plunger and the upper end of the lower plunger, said transition section housing an upper valve proximal to the lower end of the upper plunger, and a lower valve proximal to the upper end of the lower plunger; said transition section having a perimeter wall having at least one fluid port therethrough, and defining a valve chamber bounded by the wall and the upper and lower valves.

8. The plunger assembly as in claim 7, wherein an upper plunger flush port is provided through the wall of the upper plunger.

9. The plunger assembly as in claim 7 wherein the transition is of frustoconical configuration.

10. The plunger assembly as in claim 7 wherein the upper and lower valves comprise ball-type valves.

11. The plunger assembly as in claim 7, further comprising a seating assembly having a cylindrical bore, said seating assembly being adapted for seating engagement with a pump-seating nipple.

12. A pump assembly comprising:

(a) a pump-seating nipple adapted for mounting to a lower end of the tubing string;

(b) a seating assembly having a cylindrical bore, said seating assembly being in seating engagement with the pump-seating nipple;

(c) a plunger assembly comprising:

c.1 an upper plunger having a cylindrical wall, an upper end, and a lower end, said upper plunger defining an upper plunger chamber and having a fluid port extending through the wall and located proximal to the upper end of the upper plunger and adapted for allowing fluid entry from the tubing string into the upper plunger chamber, and said upper plunger being reciprocatingly and sealingly movable within the bore of the seating assembly;

c.2 a lower plunger having a cylindrical wall, an upper end, and a lower end, with the outer diameter of the cylindrical wall of the lower plunger being larger than the outer diameter of the cylindrical wall of the upper plunger, said lower plunger being reciprocatingly and sealingly movable within a pump barrel; and c.3 a transition section contiguously disposed between the lower end of the upper plunger and the upper end of the lower plunger, said transition section housing an upper valve proximal to the lower end of the upper plunger, and a lower valve proximal to the upper end of the lower plunger; said transition section having a wall having at least one fluid port therethrough, and defining a valve chamber bounded by the wall and the upper and lower valves;

wherein:

(d) the upper valve regulates fluid flow from the valve chamber into the upper plunger chamber.

13. The pump assembly as in claim 12 wherein the transition is of frustoconical configuration.

14. The pump assembly as in claim 12 wherein the upper and lower valves comprise ball-type valves.

15. The pump assembly as in claim 12, further comprising stop means for limiting the downstroke of the plunger assembly.

16. The pump assembly as in claim 12, further comprising an elastomeric packing element disposed within a seal-receiving groove formed in the bore of the seating assembly.

* * * * *